United States Patent [19]

Nakako et al.

[11] 4,219,403

[45] Aug. 26, 1980

[54] COAL LIQUEFACTION PROCESS AND APPARATUS THEREFOR

[75] Inventors: Yukio Nakako, Nishinomiya; Shizuo Yokota, Kobe, both of Japan

[73] Assignee: Kobe Steel, Ltd., Kobe, Japan

[21] Appl. No.: 915,575

[22] Filed: Jun. 14, 1978

Related U.S. Application Data

[63] Continuation-in-part of Ser. No. 801,920, May 31, 1977, abandoned.

[30] Foreign Application Priority Data

| | | | |
|---|---|---|---|
| May 28, 1976 | [JP] | Japan | 51-62811 |
| May 28, 1976 | [JP] | Japan | 51-62812 |
| May 28, 1976 | [JP] | Japan | 51-62813 |
| May 28, 1976 | [JP] | Japan | 51-62814 |
| May 28, 1976 | [JP] | Japan | 51-62815 |

[51] Int. Cl.[2] ..... C10G 1/06

[52] U.S. Cl. ..... 208/10; 208/8 R

[58] Field of Search ..... 208/8, 10

[56] References Cited

U.S. PATENT DOCUMENTS

| | | | |
|---|---|---|---|
| Re. 25,770 | 6/1961 | Johanson | 208/10 |
| 2,913,397 | 11/1959 | Murray et al. | 208/8 |
| 3,018,242 | 1/1962 | Gorin | 208/8 |
| 3,117,921 | 1/1964 | Gorin | 208/8 |
| 3,594,303 | 7/1971 | Kirk et al. | 208/8 |
| 3,644,192 | 2/1972 | Li et al. | 208/8 |
| 3,932,266 | 1/1976 | Sze et al. | 208/8 |

FOREIGN PATENT DOCUMENTS

| | | |
|---|---|---|
| 20957 | of 1929 | Australia . |
| 8303 | 7/1932 | Australia . |

*Primary Examiner*—C. Davis

*Attorney, Agent, or Firm*—Oblon, Fisher, Spivak, McClelland & Maier

[57] ABSTRACT

A coal liquefaction apparatus which comprises a slurry mixing tank, a preheater, a hydrogenation reactor, and a gas-liquid-solid separator or separators in series and a gas-liquid separator and at least one solid-liquid separator are interposed between the hydrogenation reactor and a dehydrogenation cyclopolycondensation reactor which is positioned upstream of the final gas-liquid-solid separator.

The coal liquefaction process comprises the steps of heat treating a slurry prepared by mixing coal fines with a hydrocarbon based solvent having a boiling point greater than 150° C. in the presence of hydrogen at a temperature of 300° to 500° C. and a pressure of 50 to 700 atms, thereby forming a gas-liquid-solid mixture; separating and removing solids from said gas-liquid-solid mixture as a reaction product; separating and removing a residuum liquid fraction from said mixture; and heat treating said residuum liquid fraction in the presence of hydrogen at a low partial pressure at a temperature of 300° to 500° C. and a pressure of 50 to 700 atms.

12 Claims, 12 Drawing Figures

COAL LIQUEFACTION PROCESS AND APPARATUS THEREFOR

This application is a continuation-in-part application of co-pending application Ser. No. 801,920, filed May 31, 1977, and now abandoned.

BACKGROUND OF THE INVENTION

1. Field of the Invention

The present invention relates to a coal liquefaction process and an apparatus therefor, and more particularly to a coal liquefaction process which can be performed efficiently to improve the yield of reaction products, particularly, the heavy oil product which is well suited as a metallurgical carbonaceous carbon material.

2. Description of the Prior Art

A coal liquefaction process is known in which coal fines are treated in the presence of hydrogen to liquify the coal. The coal fines used in the coal liquefaction process include low grade coals such as bituminous, semi-bituminous, and sub-bituminous coals and lignite as well as similar solid carbonaceous materials such as shale. According to the conventional process of the type described, coal fines, a hydrocarbon solvent having a boiling point of over 150° C., and a suitable catalyst such as a ferro-sulfuric system catalyst, if desired, are mixed in a slurry, (The use of a catalyst may not be necessary or essential because the ash in coal functions as a catalyst), and then the slurry is preheated in a preheater. A high pressure hydrogen-rich gas is added thereto preferably prior to the preheating of the slurry. The preheated slurry and a high pressure hydrogen-rich gas are passed into a reactor where a hydrogenation reaction is conducted at a high temperature and pressure, e.g., 300° to 500° C., 50 to 700 atms. Then, a mixture of reaction products of reactor effluent is introduced into two or more separators connected through pressure-reducing valves to each other, wherein the pressure is progressively reduced and gas, liquid and solid are flash distilled.

At the present time, the objective in the liquefaction of coal is to form a heavy oil product having a high boiling point for use as a metallurgical carbonaceous material for use, for instance, in the manufacture of steel-making coke or carbon electrodes for alumina electrolysis. The liquid product or effluent, generally, includes solids such as ash, unreacted coal, catalysts, and insoluble reaction products. Accordingly, the removal of these elements would improve the quality of the heavy oil product for its intended use. In general, a metallurgical carbonaceous material should have an ash content of less than 10%.

Coal liquefaction process hitherto has been beset with many formidable problems, which will be described as follows:

Problem 1

Because of excessive hydrogenation, the yield of a heavy oil fraction in the liquid reaction product is not high enough. Moreover, solids condense along with a heavy oil fraction, in the final stage separator, where solids and heavy oil are to be separated. However, in the conventional method, a mixture having a high viscosity results at this stage, so that much time and effort must be devoted to filtering in the separation stage to separate solids from the oil. For this reason, a light oil is added to lower the viscosity of the mixture, and if required, the mixture is heated, followed by centrifugal separation, sedimentation separation, or separation by means of separators such as liquid cyclones. In any event, a light oil in the case should be added to the oil in a considerable amount, and this results in an unwanted increase in the amount of the mixture to be treated, which causes an increase of the number of apparatus for separating the solid and liquid and deteriorates an economic effect. In addition, upon flash distillation, a solid fraction and a heavy oil fraction both pass through pressure reducing valves, so that if the pressure is instantaneously reduced to a considerably lower level, then wear of the pressure reducing values occurs. To avoid this, many separators and pressure reducing valves have to be used in order to gradually reduce the pressure of the system. The use of many such separators and reducing valves increases the expense of capital equipment.

Problem 2

In the coal hydrogenation reactor, a mixture of hydrogen gas or a high pressure reductive gas such as $CO+H_2O$, $CO+H_2O+H_2$, $CO+H_2$ or $H_2$ rich gas and the coal slurry which has to be preheated is subjected to a liquefaction reaction at a high temperature and pressure, followed by flash distillation to separate the product obtained into gas, liquid, and solid products. It is advantageous to introduce the slurry and the high pressure reductive gas into the reactor from its bottom and expel the products from the top of the reactor. In this case, the viscosity of the solvent is decreased because of the reaction at high pressure and temperature, so that a tendency arises for the settling of solids such as unreacted coal fines, catalysts and ash from the liquid. To avoid this problem, the upward rate of flow of the mixture is increased relative to the settling rate of solids during reaction. However, in order to achieve this objective, it is necessary to reduce the cross sectional area of the reactor to some extent, and the number of reactors connected in series should be increased to achieve sufficiently long residence times of the mixture for reaction in the reactors. This is uneconomical because many pieces of apparatus such as gas-liquid separators, pipe, and couplings must be used. Moreover, more maintenance problems arise because of the more extensive use of equipment. One of the attempts to solve this problem has been to reduce the number of reactors while the liquid effluent from one reactor is recycled to another, thereby extending the residence time of the slurry within the reactors. Alternatively, a reductive gas in great amounts is injected into the reactor to retard the settling of solids in the liquid reactant. However, in this technique, the concentration of unreacted coal in the reactor is equalized both at the entrance and exit of the reactor, so that the reactor itself changes in type from a piston flow reactor to a complete mixing reactor, with the result that the reaction efficiency decreases substantially relative to the reaction space or volume of the reactor.

Problem 3

A high boiling point and high viscosity reaction product is obtained from the bottom of the separator in the final stage of the multiple stage flash distillation. Accordingly, the degree of condensation of solids is not sufficiently high, thereby requiring further separation of solids from the liquid. However, because of the high viscosity of the reaction product, satisfactory separation of solids cannot be attained by a filtering process. For this reason, as has been described earlier, a light oil is added to the liquid product to decrease the viscosity of the mixture or heat is applied thereto, followed by centrifugal separation, sedimentation separation or separation in a liquid cyclone. Accordingly, the amount of the mixture to be treated is increased, thus failing to meet practicability requirements. It is therefore evident that no satisfactory separation process for solids has yet been found.

SUMMARY OF THE INVENTION

Accordingly, one object of the present invention is to provide a coal liquefaction process and an apparatus therefor, which improves the yield of liquified product suitable for use as a metallurgical carbonaceous material, while avoiding the wear of pressure reducing valves, and dispensing with multiple stage separators and pressure reducing valves.

Another object of the present invention is to provide a coal liquefaction process and an apparatus therefor, which provides an improved reaction efficiency relative to the space within the reactor, without using many reactors and couplings.

Still a further object of the present invention is to provide a coal liquefaction process and an apparatus therefor which improves the separating efficiency of solids from the liquid in separators after the hydrogenation reaction.

Yet a further object of the present invention is to provide a coal liquefaction process and an apparatus which eliminates the public nuisance problem caused by the disposal of catalysts.

Still a further object of the present invention is to provide a coal liquefaction process and an apparatus, in which solids may be efficiently separated from a high boiling point, high viscosity reaction product obtained from the bottom of a final stage separator, in a reasonable manner.

According to the first aspect of the present invention, solids are separated from a reaction mixture of low viscosity and at high temperature immediately after the hydrogenation reaction, and the reaction mixture from which the solids have been removed is then subjected to a dehydrogenation-cyclopolycondensation reaction under a low partial pressure of hydrogen at a high temperature under non-catalytic conditions. The dehydrogenation-cyclopolycondensation reaction is a reaction in which a light oil is dehydrogenated under non-catalytic conditions at a low hydrogen partial pressure, thereby being converted into a heavy oil, while the fraction of the reaction product which has been given a naphthenic or paraffinic-rich property because of the addition of an excessive amount of hydrogen, is dehydrogenated and cyclicpolycondensed. More particularly, the reaction mixture from the hydrogenation reactor is introduced as it is or after passing through a gas-liquid separator, into a solid-liquid separation system consisting of solid-liquid separators having pressure reducing valves, with the lower portions of the separators being connected to solid accumulating tanks, and with the top portions thereof connected to gas-lined outlet pipes. The liquid fraction separated therein is subjected to a non-catalytic heat treatment in the presence of hydrogen at a low partial pressure. Suitable solid-liquid separators employable in the present invention are cyclones, sand cones, and the like.

The non-catalytic heat treatment is such that the reaction product is maintained at a given temperature for a given period of time in the presence of hydrogen at a low partial pressure. Any type apparatus may be used, as long as the above described conditions can be maintained. For instance, a device having the same construction as that of the reactor, or heating vessel which is used for preheating may be used as the non-catalytic heat treatment vessel. More specifically, the reaction mixture from a hydrogenation reactor is introduced as it is, or after passing it through gas-liquid separators into solid-liquid separators at a temperature equal to or less than the temperature at the exit of a reactor but, in any case, a temperature 100° C. no less than the latter. In the solid-liquid separators, solids accumulate in the lower solid-accumulating tank, while liquid and gas, if any, overflow and are withdrawn through overhead gas-liquid outlet pipes. The liquid fraction thus withdrawn is mixed with a hydrogen-rich gas, as required, and then introduced into a dehydrogenation-cyclopolycondensation reactor. Meanwhile, the reaction product from the hydrogenation reactor contains an excessive amount of a high pressure hydrogen-rich gas, so that hydrogen need not be added in this stage. However, when the reaction product passes through a gas-liquid separator, the addition of hydrogen is required, or a small amount of high pressure hydrogen-rich gas should preferably be introduced into the dehydrogenation reactor. In the dehydrogenation reactor, a reaction mixture devoid of solids is maintained at a high temperature in the presence of a small amount of hydrogen or at a low partial pressure under non-catalytic conditions so that the portion of the product which possesses naphthenic or paraffinic properties, is dehydrogenated and cyclopolycondensed, thereby being converted into a heavy oil fraction which imparts an aromatic-rich property to the, oil which in turn yields a heavy oil well suited as a metallurgical carbonaceous material. In this respect, the presence of a small amount of hydrogen or a low partial pressure of hydrogen is mandatory for preventing an excessive amount of dehydrogenation-cyclopolycondensation. The reaction mixture subjected to the dehydrogenation reaction is withdrawn from the top of the dehydrogenation-cyclopolycondensation reactor, then passed through separators and then flash-distilled by reducing the pressure through pressure-reducing valves. However, because the reaction mixture is devoid of solids in this stage, the pressure-reducing valves are not damaged and there is no longer the need to separate solids from the liquid in the separator.

Meanwhile, in the solid-liquid separating system, when one solid accumulating tank becomes filled with solids, then the solid-liquid separating system therefor is shut off from the reaction-mixture-inlet passage, whereupon the pressure in the separator is reduced to atmospheric pressure by means of a pressure-reducing valve, and then, the accumulated solids are discharged through a bottom outlet port, as required. The solids thus discharged contain materials having a catalytic function, and thus may be used again in the coal slurry.

At least two solid-liquid separating devices in parallel are provided for one reaction system so that two-solid-liquid separating devices may be used alternately, i.e., according to the so-called batch system operation. More particularly, the reaction mixture from the hydrogenation reactor is first introduced under high pressure into one solid-liquid separating device, and when the device is filled with solids, then the connection is switched from the filled device to the other solid-liquid separating device in order to introduce the reaction mixture into the latter, while the pressure in the first solid-liquid separating device is reduced to atmospheric pressure in order to discharge solids therefrom. This cycle of operation is repeated for an efficient continuous separation of solids from liquid.

In the second aspect of the present invention, the diameter of the reactor is increased and the number of reactors is reduced, while retaining the desired level of efficiency required for liquefaction or the hydrogenation reaction. In other words, the upward flow velocity of the reaction mixture in the reactor is adjusted in order to accelerate the settling of solids therein, and solids thus settled are discharged from the bottom of the reactor, while a fresh catalyst is supplied, as required, thereby maintaining the desired hydrogenation reaction.

More specifically, in the present invention, at least two reactors each having a solid outlet port in the bottom of the reactors are connected in series, and a preheated mixture of a coal slurry consisting of coal fines, catalyst and a high pressure reductive gas is introduced into the first reactor through its bottom port so that it passes through the reactor at such a flow velocity that solids may settle in the reactor. In this case, the reaction mixture is separated into a relatively solid-rich layer and a relatively solid-lean layer. The solids which settle are discharged from the solid outlet port provided in the bottom portion of the reactor. In this respect, one or two solid accumulators are connected to the bottom of the reactor, so that solids may be stored therein in a sufficient amount, followed by flash distillation, and then the withdrawal of the solids. At the same time the solids present in the reaction mixture cannot be completely separated in the first reactor, and hence, overflow of solids occurs along with the reaction liquid, which are separated in the succeeding reactor in the same manner.

In the second embodiment of the present invention, the catalyst substantially separates from the liquid and is removed in the first reactor, so that fresh catalyst should be supplied to the second reactor and thereafter through pipes leading to the catalyst accumulating tank to promote the hydrogenation reaction. Accordingly, the reaction is conducted in an efficient manner because of the supply of fresh catalyst. In addition, different kinds of catalysts may be used in reactors. For instance, a catalyst of the cobalt-molybdenum system, iron or iron-sulfur which possesses a high activity in the liquefaction reaction, is used in the first reactor for a highly efficient reaction, while a catalyst of a low activity is used for the second reaction and also thereafter when the reaction medium contains a relatively small amount of unreacted coal. Furthermore, no catalyst is supplied to the final reactor, so that a product possessing a naphthenic or paraffinic property, because of excessive hydrogenation is heated in the presence of a low partial pressure of hydrogen under non-catalytic conditions for the dehydrogenation-cyclopolycondensation reaction, thereby converting the liquid product into a heavy oil product having aromatic characteristics, which is well adapted for use as a metallurgical carbonaceous material.

The flow velocity of the reaction mixture of the present invention depends on the kinds and grain sizes of coal fines and catalysts used. In short, the flow velocity should be selected such that the solids in the reaction mixture may settle, thus leaving a solid-rich layer and a solid-lean layer therein. For instance, when an iron oxide catalyst is used, and the grain sizes of the catalyst and the coal fines are 200 mesh, then the lowest flow velocity of the slurry stream should be about 10 cm/sec to prevent settling of the solids, i.e., 360 m/hour, while the flow velocity of the reaction mixture in order to fluidize the same is about 1.5 m/hour. In an ebullated type of reactor, the flow velocity should range from about 1.2 m/hour to 360 m/hour. If the flow velocity is excessively low, then the liquefaction reaction does not proceed satisfactorily, but instead, coking occurs. Thus, the flow velocity should preferably be over 10 m/hour. On the other hand, if the flow velocity is greater than 3600 m/hour, then the undesirable excessive overflow of solids takes place. The grain sizes of the coal fines and the catalyst particles should range from 50 to 400 mesh, preferably from 200 to 300 mesh. For the grain sizes in this range, the flow velocity of the slurry may range from 1 to 3600 m/hour, preferably from 10 to 400 m/hour.

In the third aspect of the present invention, the reaction mixture is separated into a solid-rich layer and a solid-lean layer, with an interface between the two layers being maintained at a given equilibrium level. In the solid-rich layer of a given volume, ash and unreacted coal fines are present which promote the hydrogenation reaction. On the other hand, in the solid-lean layer, the dehydrogenation-cyclopolycondensation reaction occurs which results in the yield of a heavy oil product having an improved aromatic property, which is preferable from the viewpoint of a desirable metallurgical carbonaceous material. In addition, the formation of two layers permits the separation of solids of a lower ash content in an increased amount. Furthermore, the solid-rich layer thus separated may be withdrawn, as required, so that solids may be added to the slurry for reuse as a catalyst, thus saving the amount of catalyst to be used. More particularly, in the present invention, in the hydrogenation reaction of coal fines, a tube having an opening tip is inserted into the hydrogenation reactor, while the other end thereof is connected to an ash accumulator which is maintained substantialy at the same pressure level as that of the hydrogenation reactor. Then, the pressure in the accumulator is adjusted so that a solid-rich layer may be introduced into the accumulator in order to maintain the interface between the two layers at a given equilibrium level, such that the volume ratio of the solid-lean layer to the solid-rich layer falls between 1/6 to 2.

In still another feature of the present invention, a tube having an open tip is inserted into the reactor through the base of the reactor, while the other end of the tube is connected to ash accumulators, which have a solid withdrawing means at the base of the reactor. The ash accumulators have gas pressure, flow rate control means and gas injection means in the tops of the accumulators. As a mixture of slurry and high pressure hydrogen-rich gas is introduced into the reactor, only the solid-lean layer is withdrawn from the top of the reactor, so that the interface between the two layers ascends. When the interface between the two layers passes over the open tip of the tube to a desired height therefrom, which depends on the reaction conditions, the size of the reactor and the like, the solid-rich layer is introduced into an ash accumulator in an amount proportional to the amount of the reaction mixture being fed therein. Upon the introduction of the solid-rich layer into the ash accumulator, a high pressure hydrogen-rich gas or hydrogen is charged into the ash accumulator substantially at the existing pressure level in the reactor, and then the pressure in the accumulator is adjusted to a level somewhat lower than the pressure in the reactor so as to allow the introduction of a solid-rich layer into an ash accumulator, i.e., by continuously bleeding a gas at a given rate therefrom. As a result, the interface between the solid-rich layer and the solid-lean layer may be maintained at a given equilibrium level. The solid-rich layer introduced into the ash accumulator is flash-distilled and added to the slurry for reuse. In the ash accumulator system, two ash accumulators may be used in an alternate embodiment.

According to the fourth aspect of the present invention, the interface between the solid-rich layer and the solid-lean layer is maintained in close vicinity to the open tip of a tube which is inserted in the reactor by withdrawing the solid-rich layer through the open tip of a tube, thereby providing an equilibrium between the solid-rich layer and the solid-lean layer.

The tube, as used herein, may be fixedly or movably inserted into the reactor, with the end thereof being connected via a pressure reducing valve to a slurry tank or a solid-liquid separator, such as a liquid cyclone. In this case, as well, the volume ratio of the solid-lean layer to the solid-rich layer should preferably range from 1/6 to 2.

If ash, catalyst and unreacted coal fines are separated from the solid-rich layer, then the hydrogenation reaction efficiency decreases, and unreacted coal undergoes a coking reaction, thereby adversely affecting the yield of an intended product.

Upon adjustment of the level of the interface between the solid-rich layer and the solid-lean layer to a vicinity close to the open tip of the tube in the reactor, when a mixture of slurry and a high pressure hydrogen-rich gas is continuously introduced into the reactor, the solid-lean layer alone is withdrawn from the top of the reactor, so that the interface between the two layers ascends to the open tip of the tube. In this stage, the solid-rich layer is withdrawn through the tube in order to maintain the interface between the two layers at an equilibrium level which is close to the open tip of the tube. The solid-rich layer thus withdrawn is flash-distilled as it is, and then added to the slurry for reuse as a catalyst, or otherwise separated into liquid and solids, while the liquid fraction is added to the solid-lean layer again, and the solid fraction is recovered so that it can be added to the slurry for reuse. In this case, the solid-rich layer thus withdrawn is of low viscosity, thus facilitating the separation into liquid and solid phases.

According to the fifth aspect of the present invention, the reaction mixture from the hydrogenation reactor is introduced as it is, or via a gas-liquid separator, into a solid-liquid separator having a solid accumulator connected to the bottom thereof. In this respect, the reaction mixture contains a solvent or a light oil and is of a low viscosity because the reaction mixture is preheated, thus providing ease of separation. In addition, a pressure-reducing valve is provided on the gas-liquid withdrawing pipe connected to the top of the solid-liquid separator, so that upon pressure reduction for flash distillation, solids will not pass through the pressure-reducing valve, thus avoiding errosion of the valve. This permits pressure reduction at a rapid rate. In this respect, part of the gas withdrawn from the solid-liquid separator may be cooled for liquefaction for further distillation in a distilling column. When the solid-liquid separator is filled with solids, then a pressure-reducing valve on a gas-liquid withdrawing pipe is opened in order to reduce the pressure to atmospheric pressure instantaneously, for flash distillation. The cycle of operation can be repeated for efficient solid-liquid separation.

DESCRIPTION OF THE PREFERRED EMBODIMENTS

Figure 1:
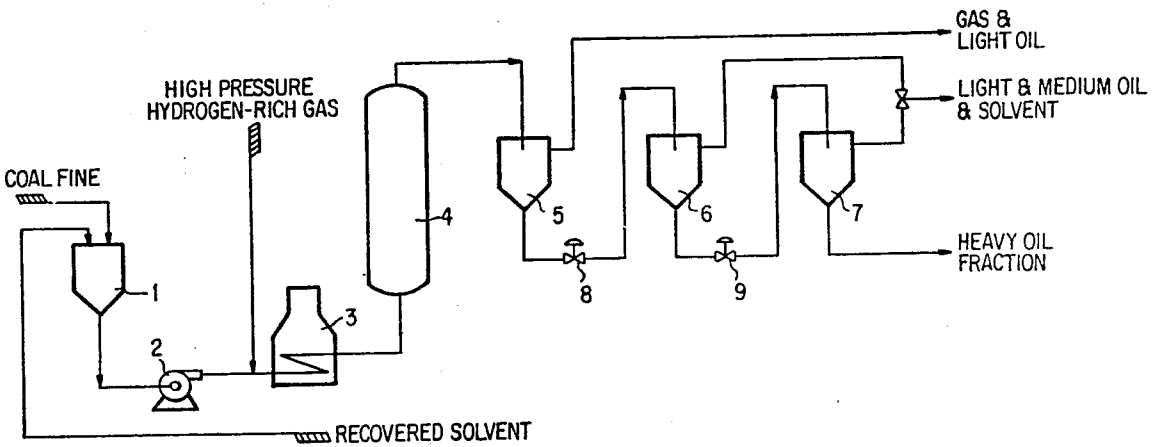
FIG. 1 is a flow sheet illustrative of a prior art liquefaction process for coal fines.

FIG. 1 illustrates a prior art liquefaction process. Coal fines and a solvent such as a hydrocarbon having a boiling point of over about 150° C., and a catalyst, if required, are slurried in a slurry tank; and then the slurry thus prepared is delivered by a slurry pump 2 to a preheater 3. Before the slurry is passed into the preheater it is mixed with a high pressure hydrogen-rich gas. The mixture of slurry and a hydrogen-rich gas, which have been preheated to about 300° to 500° C., is introduced under pressure into a hydrogenation reactor 4 through its base for reaction at a temperature of about 300° to 500° C., and a pressure of about 50 to 700 atms. The reaction mixture from the reactor 4 is passed through separators 5,6 and 7 which are connected in series in the indicated order, and then pressure-reducing valves 8, 9, provided on pipes which connect the separators in series, are opened so as to reduce the pressure gradually for flash distillation of the slurry into solids and liquid. The gas effluent withdrawn from the top of the first separator 5 is cooled for liquefaction, as desired, while a light oil fraction is distilled in a distilling column. A mixture of light and medium oils, and solvent withdrawn from the tops of separators 6 and 7 is distilled in a distilling column, and then the solvent thus recovered is recycled for use as a slurry forming solvent. Meanwhile, the heavy oil fraction withdrawn from the bottom of separator 7 contains a considerable amount of solids, which generally should be separated from the heavy oil. This is referred to as a de-ash operation.

Figure 2:
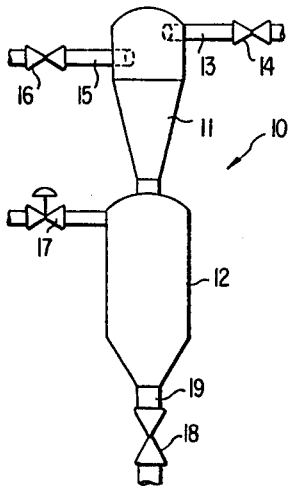
FIG. 2 is a diagrammatic view of a solid-liquid separating device within the scope of the present invention.
Figure 3:
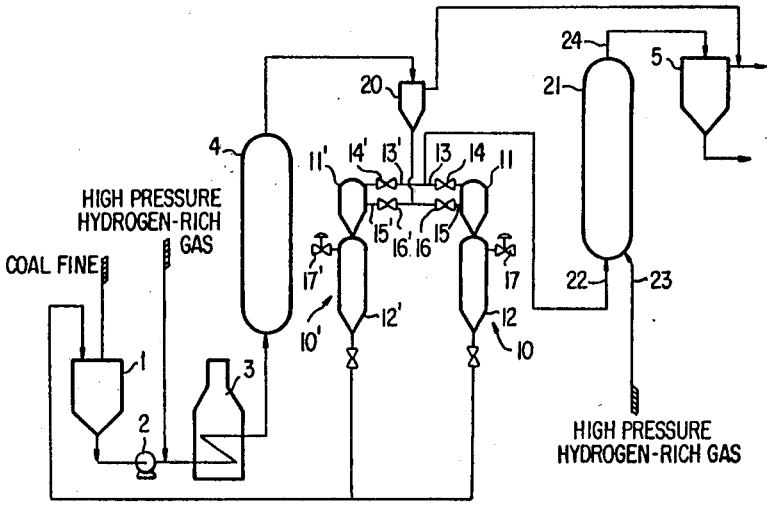
FIG. 3 is a flow sheet illustrating a liquefaction process according to the present invention, which employs two solid-liquid separating devices.

In the first embodiment of the liquefaction process of the invention, as shown in FIGS. 2 and 3, a solid-liquid separating device 10 is positioned downstream of the reactor 4, so that the reaction mixture from the reactor 4 may be separated efficiently.

The solid-liquid separating device 10 consisting essentially of a liquid cyclone 11 which is a type of solid-liquid separator, and a solid accumulating tank 12 connected to the bottom of the cyclone 11. Connected to the top of the liquid cyclone 11 is a gas-liquid outlet pipe 13, while a stop valve 14 is provided on pipe 13. A reaction mixture inlet pipe 15 is connected to the upper portion of liquid cyclone 11 at a position lower than the joint of the gas-liquid outlet pipe 13, while a stop valve 16 is also provided on pipe 15. In addition, a pressure reducing valve 17 is connected to the upper portion of solid accumulating tank 12, while a solid outlet pipe 19, having a stop valve 18, is connected to a bottom portion of tank 12.

In the liquefaction process of the invention, a non-catalytic heat treating device is positioned downstream of the solid-liquid separating device to reform the liquefaction products, thereby improving the yield of the heavy oil fraction which is suitable for use as a metallurgical carbonaceous material.

In the first embodiment of the invention, as shown in FIG. 3, two or more solid-liquid separating devices 10 and 10' are provided directly or through a gas-liquid separator 20 downstream of the reactor 4. In FIG. 3 the primed reference numerals are used to distinguish the second solid-liquid separating device and parts associated therewith for common use with those of the first device from the first device.

Gas-liquid outlet pipes 13 and 13', which are attached to solid-liquid separating devices 10 and 10', are connected to a gas-liquid inlet pipe 22, which is connected to the bottom portion of the non-catalytic heat treating device, or reactor 21. A high pressure, hydrogen rich, gas injection pipe 23 is connected to reactor 21, while an effluent outlet pipe 24 is attached to the top of reactor 21, which leads in turn to separator 5.

In the operation of the apparatus for the liquefaction process of the present invention, as shown in FIGS. 2 and 3, the reaction mixture from the reactor 4 is passed through the gas-liquid separator 20 at a temperature of about 300° to 500° C. and a pressure of about 50 to 700 atms, and then gas is withdrawn from the top of separator 20, while a solid mixture is withdrawn from the bottom thereof, which is then introduced into the first solid-liquid separating device 10. The solid-liquid mixture is subjected to a somewhat lower temperature and pressure than the reaction mixture prior to its introduction into gs-liquid separator 20. All stop valves and pressure reducing valves in the solid-liquid separating devices 10 and 10', are maintained in their closed positions at first, and then stop valve 16 on inlet pipe 15, which leads to the inlet of separating device 10, and stop valve 14 on inlet pipe 15, which leads to separating device 10 are opened to allow the introduction of the effluent from reactor 4 into device 10. The effluent is separated into a liquid-rich phase (this will be referred to simply as a liquid), and a solid-rich phase (the solid-liquid mixture will be referred to as a solid when used in terms of liquid cycline 11), while the liquid is withdrawn through outlet pipe 13 by overflow into reactor 21.

The solids thus separated accumulate in solid-accumulating tank 12. When solid-accumulating tank 12 is filled with solids, then stop valves 16' and 14' are opened. The stop valves 16 and 14 are closed, so that the introduction of the solid-liquid mixture is switched from the first separating device 10 to the second separating device 10', for the separation of solids and liquid as well as for the accumulation of solids. On the other hand, the pressure reducing valve 17 of the first separating device 10 is opened to reduce the pressure inside to atmospheric pressure, and stop valve 18 is opened so that the solids which accumulate therein are withdrawn through outlet pipe 19. The solids thus withdrawn are delivered to slurry tank 1 for reuse. Then, all stop valves and pressure reducing valves in separating device 10 are closed. When the second separating device 10' is filled to capacity with solids, then the introduction of the solid-liquid mixture is switched from the second separating device 10' to the first separating device 10. This cycle of operation can be repeated for a continuous operation.

The liquid to be delivered to reactor 21 is introduced into reactor 21 which is maintained substantially at the same temperature and pressure as that of reactor 4, wherein the liquid is subjected to treatment under non-catalytic conditions in the presence of a small amount of hydrogen which is fed into reactor 21 through gas inlet pipe 23. The treatment conditions depend on the size of the apparatus, the quality of the desired liquefaction product, and the like. In order to produce a heavy oil product which is well adapted for use as a metallurgical carbonaceous material, preferably the temperature ranges from 400° to 500° C., a total pressure of from 70 to 150 atms in the presence of hydrogen of a low partial pressure, the hydrogen partial pressure is preferably from 7 to 70% of the total pressure, and the reation time should be as long as that of the hydrogenation reaction, for instance, 5 to 90 minutes. With this treatment, a further lighter oil fraction or a reaction product having naphthenic or paraffinic-rich properties, which is produced by the addition of an excessive amount of hydrogen, may be subjected to a dehydrogenation cyclopolycondensation reaction and converted into a heavy oil fraction, which has the desired aromatic-rich property at an increased yield of 1 to 30% in comparison to the amount of starting coals (MAF or medium abrasion furnace black). The liquid thus treated is withdrawn through outlet pipe 24 which is connected to the top of reactor 21 and is delivered to the separator for further processing, which is well known.

It is apparent from the above discussion concerning the liquefaction process of the invention, a reaction mixture devoid of solids is heat-treated in the presence of hydrogen, which results in an improved yield of a heavy oil fraction, while solids may be separated under low viscosity conditions at high temperature and pressure, thereby providing improved separating efficiency and minimizing the ash content of the liquid product.

The liquefaction process achieved by hydrogenation in the present process includes:

(1) a high degree of hydrogenation of coal fines in the presence of hydrogen and catalyst of high activity such as a catalyst of the cobalt-molybdenum system, iron or iron-sulfur system at high temperature and pressure;

(2) a relatively low degree of hydrogenation in the presence of an iron system catalyst or in the absence of a catalyst in the presence of hydrogen; and
(3) liquefaction at a high temperature and high pressure in a hydrogen donor solvent having aromatic characteristics such as anthracene oil, without or in the presence of a small amount of hydrogen.

The term "hydrogenation reaction" is used herein in association with the above-described processes included in the present invention.

Figure 4:
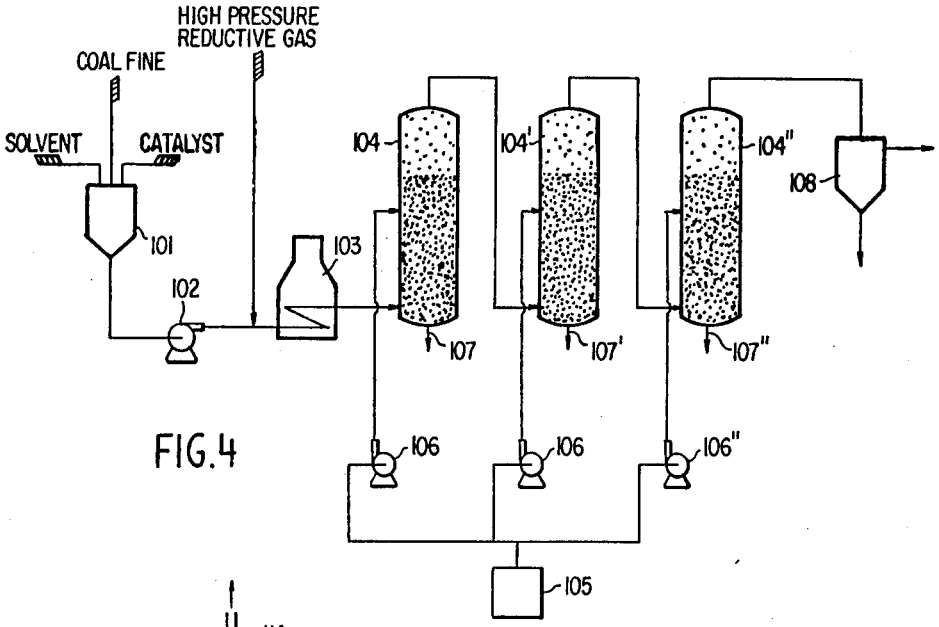
FIG. 4 is a flow sheet illustrative of one embodiment of the liquefaction process according to the present invention.

FIG. 4 illustrates the second embodiment of the liquefaction process of the present invention. Coal fines, solvent and catalyst are slurried in slurry tank 101 and then the slurry thus prepared is delivered by slurry pump 102 to preheater 103. Prior to passage of the slurry into the preheater a highly reductive gas is mixed with the slurry. The mixture of slurry and high pressure reductive gas, which has been preheated to about 300° to 500° C., is fed under pressure into the first reactor 104 through its base, wherein the mixture is passed from the bottom to the top at a flow rate (preferably 10 to 400 m/hour) such that the solids in the reaction mixture may settle against the upward flow of the mixture for reaction at a temperature of about 300° to 500° C. and a pressure of about 50 to 700 atms. The reaction mixture effluent, which overflows the top of reactor 104 is introduced into the second reactor 104' through its base, and then the reaction mixture effluent, which overflows the top of reactor 104', is introduced into the third reactor 104'' through its base. At this time, fresh catalyst from the catalyst accumulating tank 105 is slurried in a suitable solvent and then the slurry is delivered by means of pumps 106, 106' and 106'' to reactors 104, 104' and 104'', respectively. The solids which settle in the various reactors are discharged through solid outlet portions 107, 107', and 107'', positioned at the bases of the reactors. The reaction mixture effluent from the final reactor 104'' is introduced into a gas-liquid separator 108, and then part of the gas effluent from the top of the gas-liquid separator 108 is cooled for liquefaction, while the liquid residuum is further distilled in a distilling column. The liquid effluent from the base of gas-liquid separator 108 (in this case, the liquid may contain some amount of solids) is subjected to flash distillation under a reduced pressure into gas, liquid, and solids, followed by further distillation. The solids obtained from the distillation contain unreacted coal fines, catalyst and the like, and may be used repeatedly. Fresh catalyst can also be combined with the recovered catalyst for reuse.

In the reactor of the invention, the reaction mixture tends to separate into a solid-rich lower layer and a solid-lean upper layer. Accordingly, it is preferable that the flow velocity of the reaction mixture be adjusted by an appropriate means such as a tube which may be inserted into the reactor to withdraw the solid-rich layer, and that one or more solid accumulators having the same pressure as that of the reactor can be connected to the bottom of the reactor. Thus, gas is bled through the gas outlet pipes which are connected to the solid accumulators by opening the gas pressure and flow rate control valves provided on the gas outlet pipes, at a discharge rate which is commensurate with the rate a solid-rich liquid is introduced into the solid accumulators under pressure, so that an interface between the solid-rich layer and the solid-lean layer may be maintained at a given level. (In general, the volume ratio of the solid-lean layer to the solid rich layer should preferably be adjusted to 1/6 to 2.) In addition, the solid-rich liquid and the solid-lean liquid are withdrawn through the open tip of the tube inserted into the reactor, so that the interface between the solid-rich layer and the solid-lean layer may be maintained in the vicinity close to the open tip of the tube, thereby maintaining an equilibrium level within the reactor. The separation of the solid-rich layer and the solid-lean layer permits the desired dehydrogenation-cyclopolycondensation reaction to progress in the solid-lean layer, as has been described earlier, thereby increasing the yield of a heavy oil fraction having aromatic property characteristics.

A description in greater detail of the reactors will be presented.

Figure 5:
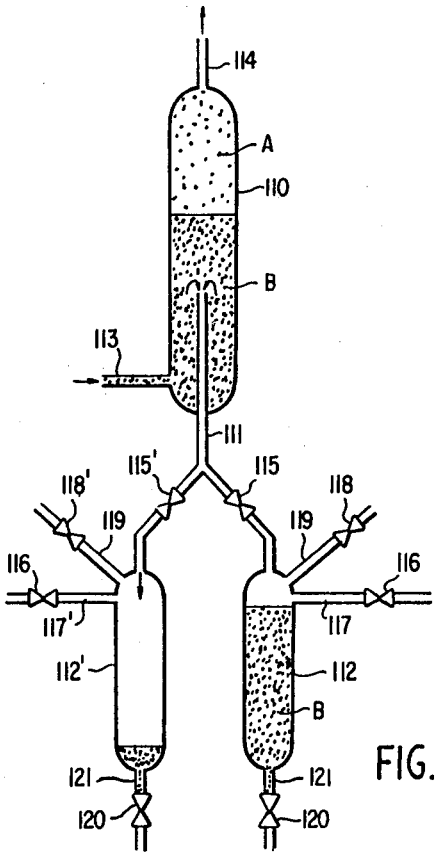
FIG. 5 is a view illustrative of one embodiment of a reactor of the present invention.

Referring to FIG. 5, reactor 110 is shown whose base is provided with an inlet port 113, which is adapted to introduce a mixture of a slurry and high pressure reductive gas therein, and whose top portion is provided with an outlet port 114, which is adapted to withdraw the solid-lean layer therethrough. Reactor 110 is connected via pipe 111 and valve 115 to a solid accumulator 112. The solid accumulator 112 has its top portion connected to a gas injection pipe 117 which is provided with a gas injection valve 116, and a gas outlet pipe 119, which is provided with a gas pressure flow rate control valve 118. A solid outlet pipe 121 having a stop valve 120 thereon for withdrawing solids therethrough is connected to the base of accumulator 112. In the reactor shown in FIG. 5, pipe 111 branches into two pipes which are connected to two solid accumulators 112 and 112', which are arranged in parallel with each other. In this respect, like parts in the second solid accumulator are designated with like primed reference numerals which are in common use with the corresponding parts of the first solid accumulator.

In operation of the reactor shown in FIG. 5, the solid accumulators 112 and 112' are isolated from communication with the reactor by closing the valves 115 and 115', and the gas pressure flow rate control valves 118 and 118' as well as stop valves 120 and 120' are closed for the first time. Then, a high pressure reductive gas is introduced through the gas injection velves 116 and 116' substantially at the same pressure as the pressure in reactor 110, after which injection valves 116 and 116' are maintained in a closed position.

A mixture of slurry and a high pressure reductive gas which has been preheated to about 300° to 500° C. is introduced through the inlet port 113 into reactor 110 at a slurry flow rate of 1 to 3600 m/hour, preferably 10 to 400 m/hour. In this case, the reactor 110 is maintained at a temperature of about 300° to 500° C. and a pressure of about 50 to 700 atms. The mixture thus introduced under pressure is separated into a solid-lean layer A (this will be referred to as layer A) and a solid-rich layer B containing ash, catalyst, and unreacted coal fines in a uniformly or thoroughly mixed condition. (This will be referred to as a layer B.) In layer B, ash and catalyst are condensed and accumulate so that the liquefaction reaction is promoted. On the other hand, in layer A, which is heated in the presence of hydrogen at a low partial pressure or a small amount of hydrogen almost under catalyst-free conditions, a light oil fraction or a reaction product, which possesses naphthenic or paraffinic-rich properties and which results from excessive hydrogenation, is subjected to a dehydrogenation-cyclopolycondensation reaction, thereby being converted into a heavy oil fraction which has aromatic properties which is best suited as a metallurgical carbonaceous material.

Layer A is continuously withdrawn through outlet port 114, while a mixture of a slurry and a high pressure reductive gas is fed under pressure through inlet port 113 into reactor 110, so that the interface between layer A and layer B ascends beyond the tip of the tube 111.

At this stage, valve 115 is opened to bring the first solid accumulator 112 into communication with reactor 110. Since accumulator 112 and reactor 110 are maintained substantially at the same pressure level, layer B is not introduced into the accumulator 112. Then, the gas pressure flow rate control valve 118 is opened, so that gas is discharged from the accumulator 112 at a rate proportional to the rate at which layer B is being introduced therein. (For instance, when the solids are present in the slurry in an amount of 25 to 40%, when the high-pressure-reductive-gas-feed rate is 14 to 30 $Nm^3$/hour, when the feed rate of slurry is 50 to 100 kg/hour, when the volume of the reactor is 100 liters, when the reaction temperature is 400° to 450° C., and when the reaction pressure is 70 to 150 atms, the feed rate of layer B is 3 to 20 kg/hour.) As a result, layer B is introduced at a given flow rate into accumulator 112 so that the interface between layer A and layer B reaches an equilibrium at a given level with the result that the volume ratio of layer A to layer B may be maintained at 1/6 to 2, as shown in FIG. 5. The above ratio is well suited for hydrogenation in layer B and dehydrogenation-cyclopolycondensation in layer A.

When a sufficient amount of layer B has been introduced into the solid accumulator 112, valve 115 is opened, valve 115 is closed, and the first accumulator 112 is shut off from the reactor 110, so that layer B may be introduced into the second accumulator 112. The layer B, which accumulates in the first accumulator 112, is subjected to flash-distillation by opening valve 118, while residuum solids are discharged through valve 120, which is maintained in its open position. Subsequently, accumulator 112 is pressurized to the same pressure level as that in reactor 110. This cycle of operation is repeated by alternately using the accumulators 112 and 112'.

Figure 6:
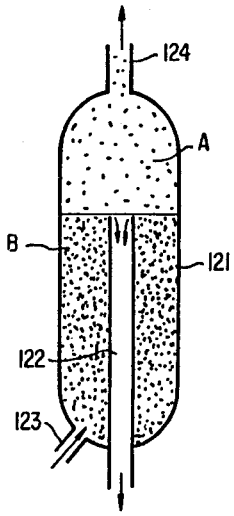
FIG. 6 is a view illustrative of another embodiment of the reactor of the present invention.

Referring to FIG. 6, reactor 121 has a tube 122 which is inserted therein through its base and opens into the reactor through its open tip, in addition to an inlet portion 123 adapted to introduce a mixture of slurry and a high pressure reductive gas, and an outlet port 124 adapted to withdraw a solid-lean layer therethrough.

In the operation of the reactor 121 shown in FIG. 6, a mixture of slurry and a high pressure reductive gas, which has been preheated to about 300° to 500° C., is introduced via inlet port 123 into the reactor 121, which is maintained at a temperature of about 300° to 500° C. and a pressure of about 50 to 700 atms. The mixture thus introduced is separated into layer A (a solid-lean layer) and layer B, which includes ash, catalyst, unreacted coal fines and the like in a uniformly or thoroughly mixed condition, i.e., a solid-rich layer. In layer B, ash and catalysts are condensed and accumulate, thereby promoting the hydrogenation reaction. On the other hand, in layer A, as in the case of FIG. 5, the dehydrogenation-cyclopolycondensation reaction takes place, so that the product is converted into a heavy oil fraction.

Layer A is continuously withdrawn through outlet port 123, while a mixture of slurry and a high pressure reductive gas is continuously fed through inlet port 123 under pressure so that the interface between the layer A and the layer B ascends.

On the other hand, the open tip of tube 122 is set at a position of 6/7 to ⅛ of the height of reactor 121. When the interface reaches the open tip of the tube 122, layer B (as well as the layer A) is withdrawn through the open tip at a rate proportional to a feed rate of a mixture. (For instance, when the solid content of the slurry is 25 to 40% by weight, when the feed rate of the high pressure reductive gas is 14 to 30 $Nm^3$/hour, when the feed rate of the slurry is 50 to 100 kg/hour, when the volume of the reactor is 100 liters, when the reaction temperature is 400° to 450° C. and when the reaction pressure is 70 to 150 atms, then the rate of layer B, which is withdrawn, is 3 to 20 kg/hour.). As a result, the interface reaches an equilibrium in the vicinity close to the open tip of tube 122, so that the volume ratio of layer A to layer B may be maintained in the range of 1/6 to 2. (See FIG. 6)

The solid-rich layer withdrawn from the bottom of tube 122 is flash-distilled into solid and liquid fractions. The solids are reused, because the solids contain unreacted coal fines, catalysts, and the like.

As is apparent from the above description, the diameter of the reactor can be increased and the number of reactors is reduced, while the flow velocity of the reaction mixture within the reactor is lowered, and the settling of the solids is promoted, so that the reactor provides the same advantages as those of a piston flow type reactor.

Figure 7:
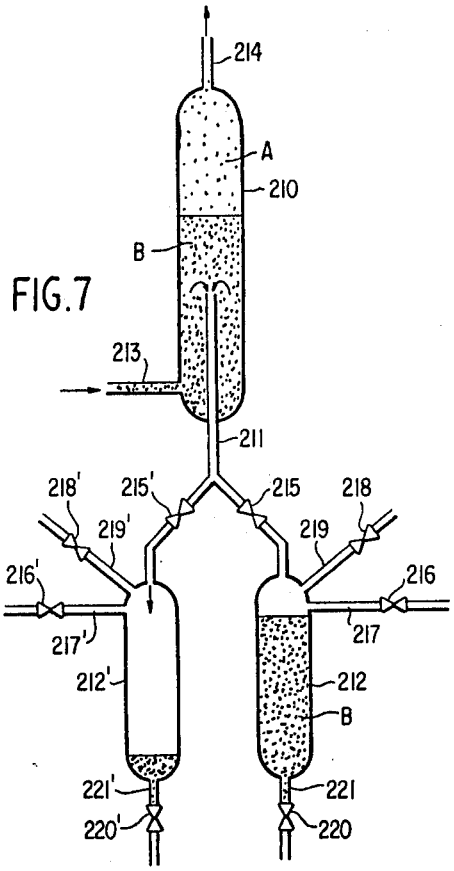
FIG. 7 is still another embodiment of a reactor of the present invention.
Figure 8:
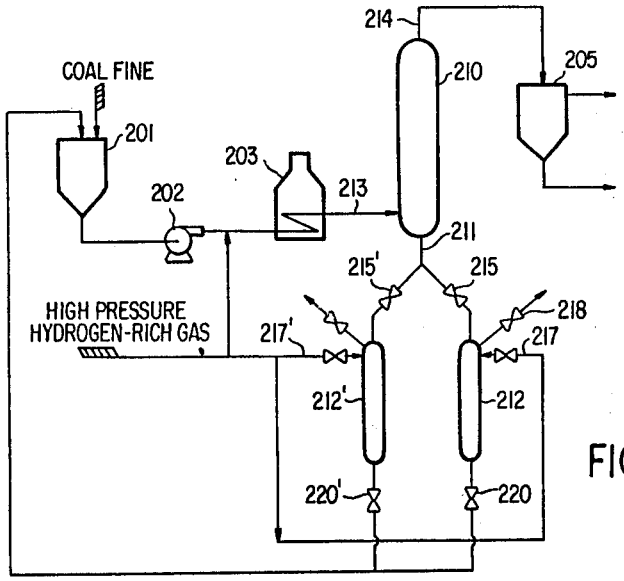
FIG. 8 is a flow sheet of the hydrogenation process of the present invention which employs the reactor of FIG. 7.

Attention will now be turned to the third embodiment of the present invention with reference to FIGS. 7 and 8. A hydrogenation reactor 210 is equipped with an inserted tube 211, with its open tip positioned therein. Tube 211 is connected to an ash accumulator 212 at the other end of the tube.

The reactor 210 is provided with an inlet port 213 adapted to introduce a mixture of a slurry and a high pressure hydrogen-rich gas, and an outlet port 214 adapted to withdraw a solid-lean layer at its top. The reactor 210 is connected via a pipe 212 and valve 215 to the ash accumulator 212. A gas injection pipe 217 equipped with a gas injection valve 216, and a gas discharge pipe 219 equipped with a gas pressure, flow rate control valve 218 are connected to the top of the ash accumulator 212, while a solid withdrawing pipe 221 equipped with a stop valve 220 is connected to the bottom portion of the ash accumulator 212. In the embodiment shown in FIG. 7, tube 212 is branched into two lines which are connected to two ash accumulators 212 and 212', which are arranged in parallel with each other, respectively. As in the previous embodiment, like parts in the second ash accumulator are designated by like primed reference numerals, which are used in common with those of the first ash accumulator 212.

As shown in FIG. 8, a pipe 213 leading from preheater 203 is connected to reactor 210 and the outlet port of reactor 210 is connected to a separator 205 via conduit 214. A high pressure hydrogen-rich gas supply pipe is connected to gas injection pipes 217 and 217' for the ash accumulators 212 and 212', while solid-withdrawing pipes 221 and 221' are connected to slurry tank 201.

In the operation of the liquefaction apparatus of the present invention as shown in FIGS. 7 and 8, the ash accumulators 212 and 212' are isolated from reactor 210 by closing valves 215 and 215' and the gas pressure flow-rate control valves 218 and 218' and stop valves 220 and 220' are closed for the first time. Then, a high pressure hydrogen-rich gas is introduced through gas injection valves 216 and 216' into ash accumulators 212 and 212' in order to bring the pressures therein to the level of the pressure in reactor 210, after which the injection valves 216 and 216' are maintained closed.

A mixture of slurry and a high pressure hydrogen-rich gas, which have been preheated to about 300° to 500° C. is introduced at a slurry flow rate of 1 to 3600 m/sec. preferably 10 to 400 m/sec, into reactor 210 which is maintained at a temperature of about 300° to 500° C. and a pressure of about 50 to 700 atms. The mixture thus introduced under pressure is separated into a solid-lean layer A and a solid-rich layer B containing ash, catalyst, and unreacted coal fines in a uniformly mixed condition. A hydrogenation reaction is promoted in layer B because ash and catalyst are condensed and accumulate therein. In layer A, the mixture is heated in the presence of hydrogen at a low partial pressure or a small amount of hydrogen almost under catalyst-free conditions, so that a light oil or part of a product which possesses naphthenic or paraffinic-rich properties, because of the addition of an excessive amount of hydrogen is converted into a heavy oil fraction which has aromatic properties and is therefore suitable as a metallugrical carbonaceous material, as prepared from the dehydrogenation-cyclopolycondensation reaction.

Layer A is withdrawn through outlet port 214 into separator 205, while a mixture of the slurry and a high pressure hydrogen-rich gas is continuously fed through inlet port 213 into the reactor, so that the interface between layer A and layer B ascends beyond the open tip of tube 211. In this stage, valve 215 is opened in order to bring the first ash accumulator 212 into communication with reactor 210. Accumulator 212 and reactor 210 are maintained almost at the same pressure level so that layer B is not fed into accumulator 212. Then, the gas pressure flow-rate control valve 218 is opened so that gas may be discharged from accumulator 212 at a rate proportional to the feed rate of layer B. Layer B is fed into accumulator 212 at a given feed rate so that the interface between layer A and layer B reaches a given equilibrium level above the open tip of tube 211, with the result that the volume ratio of layer A to layer B may be maintained over a range of 1/6 to 2. (FIG. 7) The above ratios are well suited for the hydrogenation reaction in layer B, and the dehydrogenation-cyclopolycondensation reaction in layer A.

Valve 215' is opened when layer B is introduced into ash accumulator 212 in a sufficient amount. Thereafter, valve 215 is closed so that the first accumulator 212 is isolated from reactor 210, thereby introducing layer B into the second accumulator 212', in the same manner as that of the first accumulator. The pressure reducing valve 218 is opened and the mixture is flash-distilled from the first accumulator 212. After the pressure in the accumulator 212 has been returned to atmospheric pressure, stop valve 220 is opened so that solids are withdrawn through the solid withdrawing or outlet pipe 221 and fed to slurry tank 201 for reuse. Subsequently, accumulator 212 is pressurized to the same pressure level as that in reactor 210. The above cycle of operation is repeated for the alternate use of accumulators 212 and 212'.

As is apparent from the above-described liquefaction process of the present invention, a mixture is separated into a solid-lean layer and a solid-rich layer for different types of reactions, so that ash and catalyst contents may be allowed to settle in order to promote the hydrogenation reaction, while the dehydrogenation-cyclopolycondensation reaction is promoted in the solid-lean layer so that the yield of the heavy oil fraction, suitable for use as a metallurgical carbonaceous material, is increased. In addition, solids may be separated in the reactor so that the ash content of the mixture may be reduced and the catalyst may be reused, which provides a considerable economic advantage as well as avoiding the public nuisance problem of the disposal of the catalyst wastes. The conditions of the operation are the same as those of the preceding embodiment, i.e., the withdrawal rate of layer B should preferably be in the range of 3 to 20 kg under the same conditions as those of the preceding embodiment.

The fourth embodiment of the liquefaction process of the present invention will be described with reference to FIGS. 9 and 10.

Figure 9:
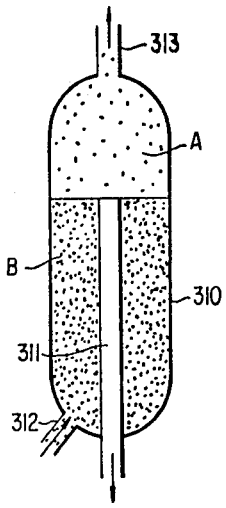
FIG. 9 is a yet another embodiment of the reactor of the present invention.
Figure 10:
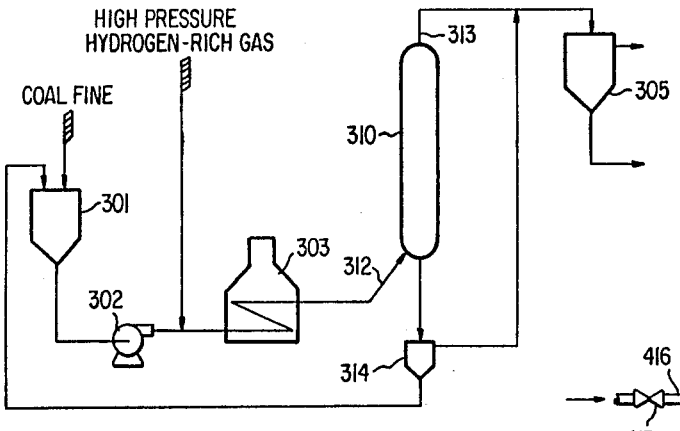
FIG. 10 is a flow sheet illustrative of one embodiment of the liquefaction process of the present invention which employs the reactor of FIG. 9.

FIG. 9 shows a reactor 310 of the present invention. The reactor 310 is provided with tube 311 which is inserted through the base of the reactor with its open tip positioned therein. The reactor 310 further is provided with an inlet portion 312 in its base which is adapted to introduce a mixture of a slurry and a high pressure hydrogen-rich gas, as well as an outlet port 313 at the top which is used to withdraw a solid-lean layer therefrom. As shown in FIG. 10, a pipe leading from preheater 303 is connected to inlet port 312 of reactor 310, while outlet port 313 is connected to separator 305. The lower end of tube 311 is connected to solid-liquid separator 314.

In the operation of the liquefaction apparatus of the present invention, a mixture of a slurry and a high pressure hydrogen-rich gas, which has been preheated to a temperature of about 300° to 500° C. is introduced at a slurry flow rate of 1 to 3600 m/hour, preferably 10 to 400 m/hour through inlet port 312 into reactor 310, which is maintained at a temperature of about 300° to 500° C. and a pressure of about 50 to 700 atms. The mixture thus introduced under pressure into reactor 310 is separated into a solid-lean layer A and a solid-rich layer B including ash, catalyst, and unreacted coal fines in a uniformly or thoroughly mixed condition. In layer B, since ash and the catalyst settle and accumulate, the hydrogenation reaction may be promoted in the reactor. Layer A is heated in the presence of hydrogen at a low partial pressure or a small amount of hydrogen, almost in a catalyst-free condition, and a light oil or a portion of the reaction product which has achieved a naphthenic or paraffinic-rich property by the addition of an excessive amount of hydrogen is subjected to a dehydrogenation-cyclopolycondensation reaction so that the reaction product is converted into a heavy oil of an aromatic-rich property, and is therefore well suited as a metallurgical carbonaceous material, thereby improving the yield of the heavy oil product.

Layer A is withdrawn through outlet line 313 into separator 305, while a mixture of a slurry and a high pressure hydrogen-rich gas is continuously introduced through inlet port 312 so that the interface between layer A and layer B ascends.

On the other hand, the open tip of the tube 311 is set to a height of 6/7 to $\frac{1}{3}$ of the height of reactor 310. When the interface between the two layers reaches the open tip of the tube in reactor 310, layer B is withdrawn through the open tip at a rate which is commensurate with the feed rate of the mixture. As a result, the interface is maintained in the vicinity close to the open tip of tube 311 at all times, so that the volume ratio of layer A to layer B may be maintained from 1/6 to 2. (FIG. 9)

The layer B thus withdrawn is separated into solid and liquid fractions in solid-liquid separator 314, while solids are delivered for reuse to slurry tank 1, and the liquid fraction is fed to separator 305 for further processing by conventional prior are procedures.

The advantages and conditions of withdrawal of layer B are the same as those in the preceding embodiment.

The fifth embodiment of the liquefaction apparatus of the invention will be described with reference to FIGS. 11 and 12.

Figure 11:
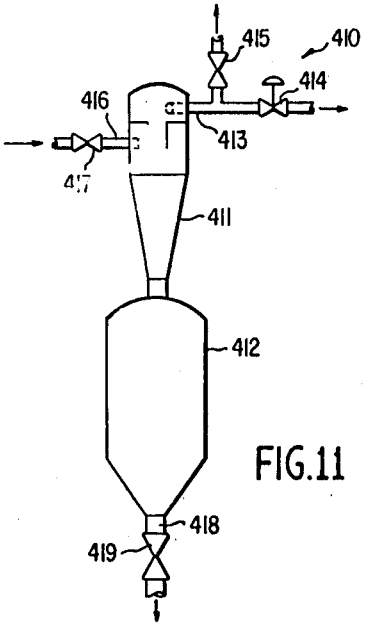
FIG. 11 is a diagrammatic view of another embodiment of the solid-liquid separating device of the present invention.

As shown in FIG. 11, a solid-liquid separating device 410 is positioned downstream of reactor 404, thereby efficiently separating solids from the reaction mixture which is introduced from reactor 404. The solid-liquid separating device 410 consists essentially of a liquid cyclone 411 which is one type of a solid-liquid separator, and a solid accumulator 412, which is connected to the bottom portion of cyclone 411. A gas-liquid withdrawing or outlet pipe 413 is connected to the top portion of liquid cyclone 411, and a pressure reducing valve 414 is provided on a branch line of pipe 413, while a stop valve 415 is provided in another branch line of pipe 413. A reaction mixture inlet pipe 416 is connected to the top portion of liquid cyclone 411 at a position lower than the point of juncture of the gas-liquid withdrawing pipe 413 with cyclone 411. A stop valve 417 is provided on pipe 416. In addition, a stop valve 419 is provided at the solid outlet port 418 at the base of solid-accumulating tank 412.

Figure 12:
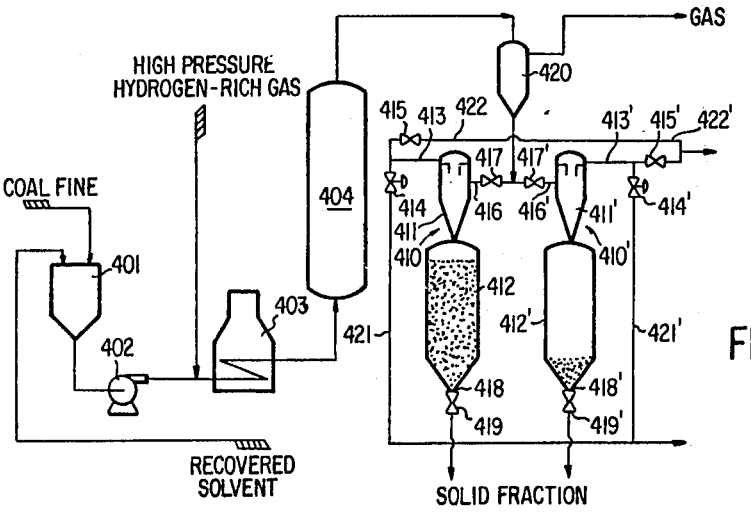
FIG. 12 is a flow sheet illustrative of the liquefaction process of the present invention which employs two solid-liquid separating devices.

Two or more solid-liquid separating devices 410 and 410' are provided as shown in FIG. 12, directly or via a gas-liquid separator 420 downstream of the reactor 404. (Two solid-liquid separating devices 410 and 410' are provided in FIG. 12.) Like parts in the second solid-liquid separating device in FIG. 12 are designated with like primed reference numerals for common use with the corresponding parts of the first solid-liquid separating device 410. The operation of the apparatus of the present invention for separating and removing solids from a liquified reaction product will be described with reference to FIG. 12. A mixture from the top of reactor 404, which is maintained at a temperature of about 300° to 500° C. and a pressure of about 50 to 700 atms, is passed through the gas-liquid separator 420 so that gas may be withdrawn from the top of the separator 420, while a solid-liquid mixture is introduced into the first solid-liquid separating device 410 through its base. The solid-liquid mixture introduced into the solid-liquid separating device is somewhat low in temperature and pressure in comparison to the temperature and pressure of the reaction mixture prior to introduction into a gas-liquid separator. When a solid-liquid mixture is introduced into the solid-liquid separating device 410, the stop valve 417 on the inlet pipe 416 is opened, while the stop valve 417' on the inlet pipe 416' to the second solid-liquid separator 416' is closed.

The solid-liquid mixture thus introduced is separated into a solid-lean phase and a solid-rich phase in the liquid cyclone 411. The liquid overflows through the gas-liquid withdrawing pipe 413, while stop valve 415, pressure reducing valve 414 and stop valve 419 are closed. The solids accumulate in the solid accumulating tank 412. When the solids have accumulated in the solid accumulating tank 412, the stop valve 417 is closed, while the stop valve 417' is opened in order to switch the introduction of the solid-liquid mixture from the first solid-liquid separating device 410 to the second solid-liquid separating device 410', for the separation of solid and liquid and the accumulation of solids. On the other hand, after the switching operation, the pressure reducing valve 414 is opened while the stop valves 417 and 415 are closed so as to isolate the aforesaid solid-liquid separating device from the other system in order that the pressure in the device may be reduced to atmospheric pressure instantaneously for flash-distillation, thereby separating the same into gas-liquid and solids. The gas and liquid are withdrawn through the gas-liquid outlet pipe 413 and line 421. The solids which condense are withdrawn through the solid outlet port 418 in the base of the solid accumulating tank by opening stop valve 419. When the first solid-liquid separating device 410 becomes empty and the second solid-liquid separating device 410' is filled with solids, the introduction of the solid-liquid mixture is switched from the second solid-liquid separating device 410' to the first solid-liquid separating device 410. Likewise, flash-distillation is conducted therein for separation of the mixture into gas, liquid and solids. In this manner, two solid-liquid separating devices are used alternately for an efficient operation by a so-called batch system operation. The gas and liquid effluents withdrawn through lines 421 and 421' pass through a condensor, as required, so that a portion of the gas may be cooled and liquefied. The liquid is further distilled in a distilling column. On the other hand, the liquid effluent withdrawn through lines 422 and 422' is further distilled in a distilling column so that the solvent which is recovered is reused as a slurry solvent. The gas product withdrawn from the top portion of the gas-liquid separator 420 is cooled and liquefied in a condensor as required.

As is apparent from the foregoing discussion, a liquefied reaction product may be separated into solids and liquid under considerably low viscosity conditions thereby dispensing with the prior art necessity of adding a light oil to the liquid to lower the viscosity thereof, thus allowing for the separation and removal of solids in an efficient manner with the accompanying improvement in quality. In addition, the size of an apparatus may be reduced to a considerable extent in comparison to the size of the prior art apparatus thus achieving the desired saving in equipment investment. Furthermore, upon flash distillation, by reduction of pressure in the system, solids do not pass through the pressure reducing valves, thus preventing valve corrosion problems. This further permits the reduction of the pressure to atmospheric pressure instantaneously, thereby avoiding the need to provide many separators. Still furthermore, in the de-ashing operation of the prior art, heat is needed to lower the viscosity of the mixture, while the apparatus according to the present invention requires no such heating, thus saving energy.

Having now fully described the invention, it will be apparent to one of ordinary skill in the art that many changes and modifications can be made thereto without departing from the spirit or scope of the invention as set forth herein.

What is claimed as new and intended to be secured by Letters Patent is:

1. A coal liquefaction process which comprises:

admixing coal fines with a hydrocarbon solvent having a boiling point greater than 150° C. to form a coal slurry;

admixing with said coal slurry a hydrogen-rich gas;

hydrogenating said coal slurry by heating said hydrogen-containing admixture at a temperature of from 300° to 500° C. and a pressure of from 50 to 700 atms whereby said coal fines are liquified and a solid-liquid admixture is formed;

separating said liquid-solid admixture into liquid and solid fractions; and dehydrogenating and cyclopolycondensing said liquid fraction at a temperature of from 400° to 500° C. and a total pressure of 70–150 atms in the presence of hydrogen at a low partial pressure wherein said low partial pressure of hydrogen is in the range of 7 to 70% of said total pressure, to produce an aromatic-rich heavy oil product.

2. The process of claim 1, wherein said coal slurry is hydrogenated in the presence of a hydrogenation catalyst.

3. The process of claim 2, wherein said hydrogenation catalyst comprises cobalt and molybdenum.

4. The process of claim 2, wherein said hydrogenation catalyst comprises iron.

5. The process of claim 4, wherein said hydrogenation catalyst comprises iron and sulfur.

6. A coal liquefaction process which comprises:

admixing coal fines with a hydrocarbon solvent having a boiling point greater than 150° C. to form a coal slurry;

admixing with said coal slurry a hydrogen-rich gas;

introducing said coal slurry-gas mixture into the lower portion of a reactor at an upward flow rate such that a solid rich layer is formed in the lower portion of said reactor and a solid lean layer is formed in the upper portion of said reactor;

maintaining said reactor at a temperature of from 300° to 500° C. and at a pressure of from 50 to 700 atms whereby said coal slurry is hydrogenated in said solid rich-layer and the resulting liquid reaction product is dehydrogenated and cyclopolycondensed in said solid lean layer; and withdrawing a portion of said solid lean layer to thereby recover a heavy oil product.

7. The process of claim 6, wherein the volume ratio of said solid lean layer to said solid rich layer is from 1:6 to 2:1.

8. The process of claim 6, wherein said coal slurry contains a hydrogenation catalyst.

9. The method of claim 8, wherein said solid lean layer is essentially free of said hydrogenation catalyst.

10. The process of claim 6, wherein a portion of said solid rich layer is withdrawn; the solid and liquid components of said layer separated; and the solid components admixed with said coal slurry.

11. The process of claim 6, wherein said upward flow rate is from 1 to 3,600 m/hour.

12. The process of claim 11, wherein said upward flow rate is from 10 to 400m/hour.

* * * * *